US006132633A

United States Patent [19]

Carlson

[11] Patent Number: 6,132,633

[45] Date of Patent: Oct. 17, 2000

[54] AQUEOUS MAGNETORHEOLOGICAL MATERIAL

[75] Inventor: J. David Carlson, Cary, N.C.

[73] Assignee: Lord Corporation, Cary, N.C.

[21] Appl. No.: 09/340,249

[22] Filed: Jul. 1, 1999

[51] Int. Cl.[7] ..... H01F 1/44

[52] U.S. Cl. ..... 252/62.52; 252/62.56; 252/62.55

[58] Field of Search ..... 252/62.51 R, 62.51 C, 252/62.52, 62.55, 62.56

[56] References Cited

U.S. PATENT DOCUMENTS

| | | | |
|---|---|---|---|
| Re. 32,573 | 1/1988 | Furumura et al. | 252/62.52 |
| 2,575,360 | 11/1951 | Rabinow | 252/62.52 |
| 2,661,825 | 12/1953 | Winslow | 192/21.5 |
| 2,886,151 | 5/1959 | Winslow | 252/62.52 |
| 5,277,281 | 1/1994 | Carlson et al. | 188/267 |
| 5,353,839 | 10/1994 | Kordonsky et al. | 137/906 |
| 5,390,121 | 2/1995 | Wolfe | 364/424.05 |
| 5,446,076 | 8/1995 | Sommese et al. | 523/200 |
| 5,487,840 | 1/1996 | Yabe et al. | 252/62.51 R |
| 5,547,049 | 8/1996 | Weiss et al. | 188/267 |
| 5,578,238 | 11/1996 | Weiss et al. | 252/62.52 |
| 5,599,474 | 2/1997 | Weiss et al. | 252/62.52 |
| 5,645,752 | 7/1997 | Weiss et al. | 252/62.54 |
| 5,670,077 | 9/1997 | Carlson et al. | 252/62.52 |
| 5,816,587 | 10/1998 | Stewart et al. | 280/5.516 |

FOREIGN PATENT DOCUMENTS

WO 98/29521 7/1998 WIPO .

OTHER PUBLICATIONS

"Bentone, Baragel, Nykon Rheological Additives—Organoclay Gellants for the Lubrication Industry" Rheox, Inc. no date.

*Primary Examiner*—C. Melissa Koslow
*Attorney, Agent, or Firm*—Wayne W. Rupert

[57] ABSTRACT

Magnetorheological fluid compositions that include an aqueous carrier fluid, magnetic-responsive particles and an additive selected from bentonite or hectorite. This fluid exhibits excellent stability and is easy to re-disperse. Preferably, all the ingredients are inorganic.

9 Claims, No Drawings

AQUEOUS MAGNETORHEOLOGICAL MATERIAL

FIELD OF THE INVENTION

The present invention is directed to water-based fluid materials that exhibit substantial increases in flow resistance when exposed to magnetic fields.

BACKGROUND OF THE INVENTION

Magnetorheological fluids are fluid compositions that undergo a change in apparent viscosity in the presence of a magnetic field. The fluids typically include ferromagnetic or paramagnetic particles dispersed in a carrier fluid. The particles become polarized in the presence of an applied magnetic field, and become organized into chains of particles within the fluid. The particle chains increase the apparent viscosity (flow resistance) of the fluid. The particles return to an unorganized state when the magnetic field is removed, which lowers the viscosity of the fluid.

Magnetorheological fluids have been proposed for controlling damping in various devices, such as dampers, shock absorbers, and elastomeric mounts. They have also been proposed for use in controlling pressure and/or torque in brakes, clutches, and valves. Magnetorheological fluids are considered superior to electrorheological fluids in many applications because they exhibit higher yield strengths and can create greater damping forces.

Magnetorheological fluids are distinguishable from colloidal magnetic fluids or ferrofluids. In colloidal magnetic fluids, the particle size is generally between 5 and 10 nanometers, whereas the particle size in magnetorheological fluids is typically greater than 0.1 micrometers, usually greater than 1.0 micrometers. Colloidal magnetic fluids tend not to develop particle structuring in the presence of a magnetic field, but rather, the fluid tends to flow toward the applied field.

Some of the first magnetorheological fluids, described, for example, in U.S. Pat. Nos. 2,575,360, 2,661,825, and 2,886,151, included reduced iron oxide powders and low viscosity oils. These mixtures tend to settle as a function of time, with the settling rate generally increasing as the temperature increases. One of the reasons why the particles tend to settle is the large difference in density between the oils (about 0.7–0.95 g/cm$^3$) and the metal particles (about 7.86 g/cm$^3$ for iron particles). The settling interferes with the magnetorheological activity of the material due to non-uniform particle distribution. Often, it requires a relatively high shear force to re-suspend the particles.

A limitation of these magnetorheological fluids is that they are prepared with organic carrier fluids, such as oils, which can become polymerized, degrade, promote growth of bacteria and be flammable. In addition, organic carrier fluids can be incompatible with components of the device in which it is used. It would be advantageous to have magnetorheological fluids that do not include organic carrier fluids or which only include water-miscible organic solvents, to overcome the limitations of oil-based magnetorheological fluids.

Prior attempts at preparing water-based magnetorheological fluids used various thickening agents, such as xanthan gum and carboxymethyl cellulose as described in U.S. Pat. No. 5,670,077. These formulations can be difficult to mix, and tend to settle over time.

In addition to particle settling, another limitation of the fluids is that suspension agents such as silica and silicon dioxide tend to cause wear when they are in moving contact with the surfaces of various parts. It would be advantageous to have magnetorheological fluids that do not cause significant wear when they are in moving contact with surfaces of various parts. It would also be advantageous to have magnetorheological fluids using water-based solvent systems that are capable of being re-dispersed with small shear forces after the magnetic-responsive particles settle out. The present invention provides such fluids.

SUMMARY OF THE INVENTION

The magnetorheological material compositions of the invention include an aqueous carrier fluid, magnetic-responsive particles, and bentonite or hectorite. The aqueous carrier fluid preferably makes up between about 10 and 50 percent by weight of the composition. The magnetic-responsive particles preferably make up between about 50 and 90 percent by weight of the composition. The bentonite or hectorite preferably makes up between about 0.1 and 10 percent by weight of the composition. The fluids typically develop structure when exposed to a magnetic field in as little as a few milliseconds. The fluids can be used in devices such as clutches, brakes, exercise equipment, composite structures and structural elements, dampers, shock absorbers, haptic devices, electric switches, prosthetic devices, including rapidly setting casts, and elastomeric mounts.

The bentonite or hectorite is present as an anti-settling agent, which provides for a soft sediment once the magnetic particles settle out. The soft sediment provides for ease of re-dispersion. The bentonite or hectorite is also thermally, mechanically and chemically stable. The fluids of the invention shear thin at shear rates less than 100/sec$^{-1}$, and recover their structure after shear thinning in less than five minutes. In addition, preferably all the components or ingredients of the magnetorheological composition of the invention are inorganic. Since there are no organic ingredients the fluid is extremely robust. It is substantially inert, not subject to polymerization, rotting, bacteria growth or breakdown of long chain molecules at high shear.

DETAILED DESCRIPTION OF THE INVENTION

The compositions form a thixotropic network that is effective at minimizing particle settling and also in lowering the shear forces required to re-suspend the particles once they settle. Thixotropic networks are suspensions of colloidal or magnetically active particles that, at low shear rates, form a loose network or structure (for example, clusters or flocculates). The three dimensional structure imparts a small degree of the rigidity to the fluid, minimizing particle settling. When a shear force is applied to the material, the structure is disrupted or dispersed. The structure reforms when the shear force is removed.

I. Magnetorheological Fluid Composition

A. Magnetic-Responsive Particles

Any solid which is known to exhibit magnetorheological activity can be used, specifically including paramagnetic, superparamagnetic and ferromagnetic elements and compounds. Examples of suitable magnetic-responsive particles include iron, iron alloys (such as those including aluminum, silicon, cobalt, nickel, vanadium, molybdenum, chromium, tungsten, manganese and/or copper), iron oxides (including $Fe_2O_3$ and $Fe_3O_4$), iron nitride, iron carbide, carbonyl iron, nickel, cobalt, chromium dioxide, stainless steel and silicon steel. Examples of suitable particles include straight iron powders, reduced iron powders, iron oxide powder/straight iron powder mixtures and iron oxide powder/reduced iron powder mixtures. A preferred magnetic-responsive particulate is carbonyl iron, preferably reduced iron carbonyl.

The particle size should be selected so that it exhibits multi-domain characteristics when subjected to a magnetic field. Average particle diameter sizes for the magnetic-responsive particles are generally between 0.1 and 1000 $\mu$m, preferably between about 0.1 and 500 $\mu$m, and more preferably between about 1.0 and 10 $\mu$m, and are preferably present in an amount between about 50 and 90 percent by weight of the total composition.

B. Carrier fluids

The carrier fluid is a water-based or aqueous fluid. In one embodiment, water alone can be used. However, small (preferably less than 5% by weight of the total formulation more preferably 0.1 to 5% by volume) amounts of polar, water-miscible organic solvents such as methanol, ethanol, propanol, dimethyl sulfoxide, dimethyl formamide, ethylene carbonate, propylene carbonate, acetone, tetrahydrofuran, diethyl ether, ethylene glycol, propylene glycol, and the like can be added.

The pH of the aqueous carrier fluid can be modified by the addition of acids or bases. A suitable pH range is between 5 and 13, and a preferred pH range is between 8 and 9.

C. Bentonite or Hectorite

The bentonite or hectorite used in the composition of the invention are hydrophilic mineral clays that are anti-settling agents, thickening agents and rheology modifiers. Naturally occurring bentonites and hectorites include various metal cations which provide the clay with hydrophilic properties. They increase the viscosity and yield stress of the magnetorheological fluid compositions described herein. Preferably, the bentonite or hectorite is present in a range of between 0.1 and 10 percent by weight of the formulation, more preferably, between 1 and 8 percent by weight, and most preferably, between about 2 and 6 percent by weight. Preferably, clay is used to the exclusion of [i.e. substantially no amount of] organic thickeners such as xanthan gum, carboxymethyl cellulose or other polymeric additives.

The bentonite or hectorite thickens the fluid composition to slow down particle settling, and provides for a soft sediment once the magnetic particles settle out. The soft sediment provides for ease of re-dispersion. Suitable bentonites or hectorites are thermally, mechanically and chemically stable and have a hardness less than that of conventionally used anti-settling agents such as silica or silicon dioxide. Compositions of the invention described herein preferably shear thin at shear rates less than 100/sec, and recover their structure after shear thinning in less than five minutes.

Bentonite or hectorite clays are typically in the form of agglomerated platelet stacks. When sufficient mechanical and/or chemical energy is applied to the stacks, the stacks can be delaminated. The delamination occurs more rapidly as the temperature of the fluid containing the clay is increased. The clays tend to be thixotropic and shear thinning, i.e., they form networks which are easily destroyed by the application of shear, and which reform when the shear is removed. The individual clay platelets have physical and mechanical properties that make them ideally suited for use in the magnetorheological fluid compositions described herein. For example, they are extremely flexible and at the same time are extremely strong.

The preferred clay is a member of the Laponite group of synthetic hectorites produced by Southern Clay Products, Gonzales, Tex. Laponites are layered hydrous magnesium silicates, which are free from natural clay impurities and is synthesized under controlled conditions. When added to water with moderate agitation, an optimum dispersion should be obtained in about 30 minutes. The viscosity of the Laponite suspensions will increase upon addition of the metal particulates.

When the composition is prepared, it may be necessary to subject the clays to high shear stress to delaminate the clay platelets. There are several means for providing the high shear stress. Examples include colloid mills and homogenizers.

D. Optional Components

Optional components include carboxylate soaps, dispersants, corrosion inhibitors, lubricants, extreme pressure anti-wear additives, antioxidants, thixotropic agents and conventional suspension agents. Carboxylate soaps include ferrous oleate, ferrous naphthenate, ferrous stearate, aluminum di- and tri-stearate, lithium stearate, calcium stearate, zinc stearate and sodium stearate, and surfactants include sulfonates, phosphate esters, stearic acid, glycerol monooleate, sorbitan sesquioleate, laurates, fatty acids, fatty alcohols, fluoroaliphatic polymeric esters, and titanate, aluminate and zirconate coupling agents and other surface active agents. Polyalkylene diols (i.e., polyethylene glycol) and partially esterified polyols can also be included.

Suitable corrosion inhibitors are described in U.S. Pat. No. 5,670,077 and include sodium nitrite, sodium nitrate, sodium benzoate, borax, ethanolamine phosphate and mixtures thereof. The corrosion inhibitor can be present in an amount between 0.1 to 10 percent by weight of the composition.

Suitable thixotropic additives are disclosed, for example, in U.S. Pat. No. 5,645,752.

II. Devices including the Magnetorheological Fluid Composition

The magnetorheological fluid compositions described herein can be used in a number of devices, including brakes, pistons, clutches, dampers, exercise equipment, controllable composite structures and structural elements. Examples of dampers that include magnetorheological fluids are disclosed in U.S. Pat. Nos. 5,390,121 and 5,277,281, the contents of which are hereby incorporated by reference. An apparatus for variably damping motion which employs a magnetorheological fluid can include the following elements:

a) a housing for containing a volume of magnetorheological fluid;

b) a piston adapted for movement within the fluid-containing housing, where the piston is made of a ferrous metal, incorporating therein a number N of windings of an electrically conductive wire defining a coil which produces magnetic flux in and around the piston, and c) valve means associated with the housing an/or the piston for controlling movement of the magnetorheological fluid.

U.S. Pat. No. 5,816,587, the contents of which are hereby incorporated by reference, discloses a variable stiffness suspension bushing that can be used in a suspension of a motor vehicle to reduce brake shudder. The bushing includes a shaft or rod connected to a suspension member, an inner cylinder fixedly connected to the shaft or rod, and an outer cylinder fixedly connected to a chassis member. The magnetorheological fluids disclosed herein can be interposed between the inner and outer cylinders, and a coil disposed about the inner cylinder. When the coil is energized by electrical current, provided, for example, from a suspension control module, a variable magnetic field is generated so as to influence the magnetorheological fluid. The variable stiffness values of the fluid provide the bushing with variable stiffness characteristics.

The flow of the magnetorheological fluids described herein can be controlled using a valve, as disclosed, for example, in U.S. Pat. No. 5,353,839, the contents of which are hereby incorporated by reference. The mechanical properties of the magnetorheological fluid within the valve can be varied by applying a magnetic field. The valve can include a magnetoconducting body with a magnetic core that houses an induction coil winding, and a hydraulic channel located between the outside of the core and the inside of the body connected to a fluid inlet port and an outlet port, in which magnetorheological fluid flows from the inlet port through the hydraulic line to the outlet port. Devices employing magnetorheological valves are also described in the '839 patent.

Controllable composite structures or structural elements, such as those described in U.S. Pat. No. 5,547,049 to Weiss et al., the contents of which are hereby incorporated by reference, can be prepared. These composite structures or structural elements enclose magnetorheological fluids as a structural component between opposing containment layers to form at least a portion of any variety of extended mechanical systems, such as plates, panels, beams and bars or structures including these elements. The control of the stiffness and damping properties of the structure or structural elements can be accomplished by changing the shear and compression/tension moduli of the magnetorheological fluid by varying the applied magnetic field. The composite structures of the present invention may be incorporated into a wide variety of mechanical systems for control of vibration and other properties. The flexible structural element can be in the form of a beam, panel, bar, or plate.

III. Methods for Making the Magnetorheological Fluid Composition

The composition can be prepared by adding the bentonite or hectorite to the aqueous carrier fluid while stirring and optionally adding the anti-corrosion agent. As the bentonite or hectorite is dispersed, and the structure starts to build, the magnetic particles can be added and the mixture stirred until dispersed.

Any optional components can be added at any stage of the process. Constant product viscosity (following about thirty minutes of stirring) indicates full dispersion and activation of the clay.

The present invention will be better understood with reference to the following non-limiting examples.

A composition including 400 grams of carbonyl iron (R2430 available from Isp Corporation), 100 grams of water, 3 grams of Laponite (RD) and 2.5 grams of sodium nitrite (about 34% iron by volume) was prepared by first dispersing the Laponite in water via high speed stirring, adding sodium nitrite with stirring, and finally adding the carbonyl iron with stirring until dispersed. Another composition was prepared with 400 grams of carbonyl iron, 100 grams water, 3 grams of Laponite (RDS), and 5 grams of sodium nitrite. A third composition was prepared with 400 grams of carbonyl iron, 100 grams of water, 2 grams Laponite (RD) and 5 grams of sodium nitrite. These compositions showed excellent stability and relatively low viscosity for compositions that include 34 percent iron by volume.

A fourth comparative composition was prepared using 400 grams of carbonyl iron, 100 grams water, 3 grams Attapulgate (Min-U-Gel available from Floridan), and 2.5 grams of sodium nitrite. This composition showed rapid settling and little gel structure.

I claim:

1. A magnetorheological material comprising an aqueous carrier fluid, magnetic-responsive particles having average diameters of 0.10 to 1000 $\mu$m and at least one additive selected from bentonite and hectorite.

2. The material of claim 1 further comprising 0.1 to 5 volume percent of a water-miscible organic solvent, based on the volume of the aqueous carrier fluid.

3. The material of claim 1 wherein the magnetic-responsive particle is selected from iron, iron alloys, iron oxides, iron nitride, iron carbide, carbonyl iron, nickel, cobalt, chromium dioxide, stainless steel and silicon steel.

4. The material of claim 1 wherein the additive comprises a synthetic hectorite.

5. The material of claim 1 wherein the amount of magnetic-responsive particles is 50 to 90 percent by weight of the composition.

6. The material of claim 1 wherein the amount of aqueous carrier fluid is 10 to 50 percent by weight of the composition.

7. The material of claim 1 wherein the amount of the additive is 0.1 to 10 percent by weight of the composition.

8. The material of claim 1 wherein the magnetic-responsive particles have average diameters of greater than 1.0 $\mu$m.

9. A magnetorheological fluid wherein all the ingredients are inorganic.

* * * * *